US006489721B1

(12) United States Patent
Haitko et al.

(10) Patent No.: US 6,489,721 B1
(45) Date of Patent: Dec. 3, 2002

(54) CONTROL OF LEACHABLE MERCURY IN FLUORESCENT LAMPS

(75) Inventors: Deborah Ann Haitko, Schenectady, NY (US); John Richard Fitzpatrick, St. Albans (GB); Ronald Eric Maier, Hudson, OH (US); Stanlee Teresa Buddle, Gloversville, NY (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 09/880,995

(22) Filed: Jun. 14, 2001

(51) Int. Cl.[7] ..... H01J 1/62
(52) U.S. Cl. ..... 313/565; 313/490; 445/2
(58) Field of Search ..... 313/613, 565, 313/639, 640, 641, 609, 492, 38.01, 490; 445/2, 61, 73

(56) References Cited

U.S. PATENT DOCUMENTS 4,308,650 A * 1/1982 Hernandez et al. ..... 313/492
5,229,686 A 7/1993 Fowler et al.
5,229,687 A 7/1993 Fowler et al.
5,736,813 A 4/1998 Foust et al.
5,754,002 A 5/1998 Haitko et al.
5,821,682 A 10/1998 Foust et al.
6,229,260 B1 * 5/2001 Haitko et al. ..... 313/565

* cited by examiner

*Primary Examiner*—Vip Patel
*Assistant Examiner*—Joseph L. Williams
(74) *Attorney, Agent, or Firm*—Bernadette M. Bennett; Noreen C. Johnson

(57) ABSTRACT

A method and apparatus for preventing the formation of leachable mercury in mercury arc vapor discharge lamps is provided which comprises providing in the lamp structure an effective amount of an antioxidant composition and an iron shield wherein the iron shield comprises a dose of elemental mercury.

16 Claims, 1 Drawing Sheet

CONTROL OF LEACHABLE MERCURY IN FLUORESCENT LAMPS

BACKGROUND OF THE INVENTION

The present invention relates to a method and apparatus for preventing the formation of leachable mercury in mercury arc vapor discharge lamps.

Mercury arc vapor discharge lamps, otherwise commonly known as fluorescent lamps, are standard lighting means. The mercury arc vapor discharge lamp consists of metallic components such as lead wires, connector pins and end caps. The lead wires and portions of the end cap and connector pins are surrounded by a glass enclosure. The interior of the glass enclosure is typically coated with phosphor. Elemental mercury is added to the mercury arc vapor discharge lamp and typically, the elemental mercury adheres to the phosphor. In certain conditions, it has been found that when elemental mercury comes in contact with the metal components in a lamp such as copper and iron containing lead wires, brass pins, or other associated metallic mount components, the elemental mercury is transformed into a leachable form.

In order to address the growing concern that mercury from disposal of fluorescent lamps might leach into surface and subsurface water, the Environmental Protection Agency has established a maximum concentration level for mercury at 0.2 milligrams of leachable mercury per liter of extract fluid. The concentration level for mercury is generally determined by a standard analysis known as the Toxicity Characteristic Leaching Procedure (TCLP), a well known test procedure.

When carrying out the TCLP test, test lamps are pulverized to form lamp waste material similar to that which would result from lamp disposal in land fills or other disposal locations. The ambient conditions in disposal locations may be such as to promote formation of leachable mercury. The TCLP test conditions themselves tend to allow for formation of leachable mercury in amounts greater than the established limit of 0.2 milligrams per liter.

During the disposal of the lamp, and in the TCLP test, the glass enclosure of the lamp is broken. Elemental mercury that is contained in the lamp is then exposed to the metal components in an aqueous environment. Elemental mercury, when exposed to both the metal components and the aqueous environment, is oxidized to leachable mercury. The metal components in the lamp provide the source of oxidizable iron and oxidizable copper that promotes the formation of leachable mercury.

Several techniques have been developed which prevent the formation of mercury that can leach into the environment. The methods currently used are concerned with a method of delivering a chemical agent or metal upon disposal of a lamp or during the TCLP test. For instance, Fowler et al. (U.S. Pat. No. 5,229,686 and U.S. Pat. No. 5,229,687) describe methods that incorporate chemical agents in the lamp in either a glass capsule or the basing cement. These chemical agents include various salts such as bromide anions, chloride anions, iodide anions, iodate anions, periodate anions, and sulfide anions, to name a few. Other chemical agents include powders such as iron powder, copper powder, tin powder, and titanium powder.

In U.S. Pat. No. 5,754,002 which has been assigned to the assignee of the present invention, Haitko et al. describes the addition of a mercury antioxidant for superior TCLP test performance. Mercury antioxidants include, for example, ascorbic acid, sodium ascorbate, and calcium ascorbate. These materials have been found to reduce or prevent the formation of leachable mercurous and mercuric compounds resulting from the oxidation of elemental mercury.

Generally, any modification of the lamp components is driven by the need to decrease the amount of leachable mercury. Methods and materials are constantly being sought which decrease the leachable mercury values upon performance of the TCLP extraction test.

SUMMARY OF THE INVENTION

The present invention provides a mercury vapor discharge lamp comprising an effective amount of an antioxidant composition and an iron shield wherein the iron shield comprises a dose of elemental mercury.

The present invention further provides a method for preventing the formation of leachable mercury compounds in mercury vapor discharge lamps comprising providing in the lamp structure an effective amount of an antioxidant composition and an iron shield wherein the iron shield comprises a dose of elemental mercury.

DETAILED DESCRIPTION

Figure 1:
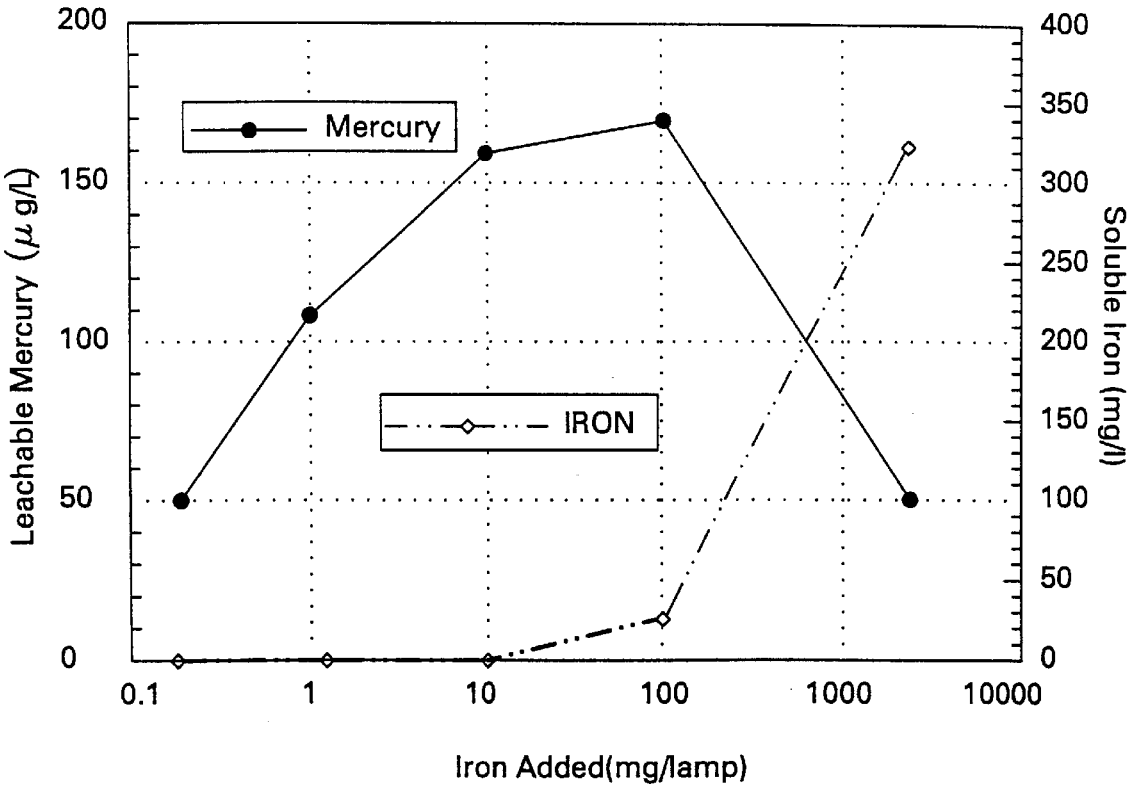
FIG. 1 is a graphical representation of the iron/leachable mercury relationship at a 20 milligram mercury ($Hg^0$) dose under TCLP test conditions.

The incorporation of an antioxidant composition in addition to an iron shield with an elemental mercury dose has been found to have a significant effect on preventing mercury compounds from leaching during the TCLP test. Accordingly, the formation and dissolution of soluble ferric and cuprous ions from the mercury vapor arc discharge lamp components is diminished or prevented resulting in reduction or prevention of leachable mercury compounds.

Lead wires are typically made of iron or copper and connector pins are typically made of brass. The lead wires and connectors pins are the source of elemental iron ($Fe^0$) and copper ($Cu^0$) that is oxidized in the presence of oxygen and an aqueous environment to ferric ($Fe^{+3}$) and cuprous ($Cu^{+1}$) ions. Ferric and cuprous ions can then dissolve in aqueous solution. The presence of ferric and cuprous compounds has been found to lead to the formation of leachable mercury.

"Leachable mercury" as used herein refers to elemental mercury ($Hg^0$) that has been oxidized. Oxidized mercury reacts with oxygen to form compounds such as mercuric oxide (HgO). Once the lamp has been broken and the elemental mercury can oxidize to leachable mercury, the leachable mercury can be carried via groundwater, rivers and streams.

Suitable antioxidants include any materials, compounds, or systems that prevent or reduce the formation of ferric and cuprous ions in the mercury-containing environment. Illustrative organic and inorganic antioxidants (reducing agents) include ascorbic acid, sodium ascorbate, calcium ascorbate, ferrous sulfate, ferrous oxide, ferrous tatrate, ferrous citrate, ferrous gluconate, ferrous chloride, dehydroascorbic acid, 2,3-dioxo-L-gulonic acid, oxalic acid, L-threoic acid, ([R-(R*,S*)]-2,3,4-trihydroxybutanoic acid), tartaric acid, furfural, 2-furoic acid, ethylglyoxal, furoin, and 2-methyl-3,8-hydroxychroman, and the like. Typically, ascorbic acid is used in the present invention.

The term "antioxidant" as used herein refers to a material which functions to prevent or reduce the formation of soluble mercury oxides (leachable mercury) from elemental or liquid mercury in the presence of ferric and cuprous ions, moisture, and oxygen. The term "antioxidant composition" refers to the antioxidant compound in admixture with a basing cement or an adhesive binder suitable for application to the metal base of a lamp.

To prevent the spurious formation of leachable mercury upon disposal of mercury vapor discharge lamps and to improve the reliability of the TCLP test, an effective amount of an antioxidant is incorporated in the lamp structure, for example within the glass envelope exterior to the plasma discharge, in an end-cap, or in the base of the lamp. An effective amount of the antioxidant is that amount which will substantially prevent formation of ferric and cuprous compounds which can oxidize elemental mercury to a soluble form with the reducing chemistry produced by the iron shield. In general, an effective amount of the antioxidant will be enough for the TCLP test results to show the presence of less than about 0.2 parts per million of leachable mercury. Typically, the antioxidant composition is present in a range between about 1 milligram and about 10 grams per lamp, and more typically, in a range between about 1 milligram and about 1 gram per lamp.

The antioxidant additive can be formulated into a thermally curable adhesive or binding composition that is soluble in acidic aqueous solutions. Such compositions generally include an inert filler material, a binder such a polyvinylmethacrylate, and a processing solvent such as denatured alcohol. The alcohol will evaporate and the composition will cure when the basing cement is cured. These ingredients are similar to the usual components of basing cements used to secure the glass envelope to the aluminum base or end cap. Gums and gelatins have also been used as such adhesives and binders. The nature of the gums and gelatins is that they adhere to surfaces when heated. The composition containing the antioxidant material can be placed on the inner surface of the aluminum end cap as a ring or discrete button. When the lamp is crushed and exposed to an aqueous environment or placed in the TCLP solution, the aqueous soluble binder allows the antioxidant to be released quickly.

Typical fillers include marble flour (calcium oxide). The binder material can be shellac, rosin synthetic resins such as a polymeric phenolic resin, or combinations thereof. Processing solvents are generally lower alcohols such as ethyl, propyl, butyl, or amyl alcohol.

The antioxidant can also be incorporated in the lamp by encapsulation of the material in a glass capsule that can be placed either in the base of the lamp between the aluminum cap and flare of leaded glass, or placed within the positive column of the lamp. The positive column is a typically under vacuum and is a portion of the lamp that includes the interior of the stem press (inner leads, cathode, iron shield with mercury dose and nickel-chrome mount wire) with phosphor and inert gases that fill the lamp. Inert gases that fill the lamp typically include argon and krypton. Since the antioxidant is enclosed in a glass capsule it could be present in the inside of the positive column of the lamp without affecting lamp function.

The antioxidant material can also be incorporated in the basing cement of the lamp that holds the aluminum cap to the leaded glass portion of the end of the lamp. The basing cement generally comprises about 80 weight % marble flour (limestone-CaO), and the balance shellac, a polymeric phenolic resin binder, a solvent for blending, and a dye used to color the cement. The cement is dispensed through a feeder into the base and heated to cure once assembled with the lamp. The curing drives off the solvent and solidifies the cement. The antioxidant is blended with the cement components and incorporated into a lamp manually or by automated manufacturing equipment. The antioxidant material is released only when the lamp is destroyed or crushed in preparation for TCLP testing. In this method, the active antioxidant material is always exterior to the positive column of the lamp.

The iron shield that is incorporated into the lamp structure typically has a dose of elemental mercury in a range between about 4.0 milligrams and about 5.0 milligrams per lamp, and more typically at about 4.5 milligrams per lamp. The elemental mercury dose is used as a standard. When there is a given amount of elemental mercury in the lamp, the amount of leachable mercury that is formed from the elemental mercury can be measured which enables development of TCLP compliant mercury arc vapor discharge lamps. Lamps without the elemental mercury dose may have varying amounts of mercury already present in the lamp which is problematic when developing TCLP compliant lamps. The iron shield is typically incorporated into the lamp via spot-welding the shield to a nickel-chromium wire that is mounted within the lead glass. The iron shield is typically placed around the cathode of the lamp.

The invention is illustrated by testing of mercury vapor arc discharge lamps via the TCLP test in which both an iron shield dosed with mercury and ascorbic acid were added to the lamp components. These examples are to be regarded as non-limiting.

All TCLP test data was obtained by the test procedure prescribed on pages 26987–26998, volume 55, number 126 of Jun. 29, 1990 issue of the Federal Register.

Briefly, lamps being tested with the TCLP test were pulverized into particulate form having the prescribed particle size that is capable of passing through a ⅜ inch sieve. The test material was then extracted with a sodium acetate-acetic acid buffer at a pH of about 4.93.

EXAMPLE 1

The TCLP test was performed upon the individual components of a mercury vapor discharge lamp in the presence of soda lime glass (to keep the abrasion constant) and elemental mercury. The tests demonstrated that the highest leachable mercury values occurred with the iron and copper containing metal components as seen in Table 1. In each case, 125 grams of glass was used with a 40 milligram elemental mercury ($Hg^0$) dose. Extractant volume was 2800 milliliters.

TABLE 1

| Lamp Component | Leachable Mercury (parts per billion) |
|---|---|
| Elemental mercury only | <50 |
| Soda Lime Glass | <50 |
| Soda Lime Glass + Electrode | <50 |
| Soda Lime Glass + Phosphor | <50 |
| Soda Lime Glass + Fe Lead Wire | 574 |
| Soda Lime Glass + Ni/Fe Lead Wire | 328 |
| Soda Lime Glass + Cu Lead Wire | 263 |
| Soda Lime Glass + Brass Pins | 246 |
| Soda Lime Glass + Al Bnd Cap | 728 |
| Soda Lime Glass + Basing Cement | 66 |

As seen in the results in Table 1, the amount of iron from the iron (Fe) lead wire was not present in a quantity that has a beneficial result on the TCLP test and the amount of leachable mercury.

EXAMPLE 2

The TCLP test was then performed on a T8 Polylux XL® lamp (obtained from GE Lighting) that contained an iron shield. The tests were performed using undosed lamps that were composed of glass, phosphor, and lead glass. In each case, 10 milligrams of elemental mercury were added. The results can be seen in Table 2.

TABLE 2

| Lamp Component | Leachable Mercury (parts per billion) |
|---|---|
| Elemental mercury only | 62 |
| Copper (Cu) leads | 545 |
| Iron (Fe) leads | 855 |
| Aluminum (Al) end cap | 582 |
| Basing Cement | 75 |
| Brass Pins | 320 |
| Iron (Fe) Shield | 192 |
| Shield Mount | 190 |
| Electrode | 72 |
| Plastic Insert (holds pins) | 63 |

From the data in Tables 1 and 2, it was apparent that different types of iron have different effects. There was a 663 parts per billion (ppb) difference between the leachable mercury values for the T8 Polylux XL iron lead wires and iron shield.

EXAMPLE 3

To show that different types of iron have different effects upon TCLP results, different materials were tested keeping the gram quantity of iron at 1.0 grams of iron component for each case. Each material tested had an elemental mercury dose of 20 milligrams. Results can be seen in Table 3.

TABLE 3

| Type of Iron | Leachable Mercury (parts per billion) |
|---|---|
| None | 358–501 |
| Iron Shield | 205 |
| Lead Wire | 335 |
| 20 millimeter Iron Sheet | 164 |
| Powder (100 mesh) | 54 |
| Wire (5 millimeter) | 64 |

EXAMPLE 4

To show that the iron concentration does have an effect upon leachable mercury, the quantity of an iron sheet was varied using undosed lamps (Cool White Wattmiser obtained from GE Lighting) and a constant elemental mercury dose of 20 milligrams. The leachable mercury values plotted against iron concentrations are shown graphically in FIG. 1. The iron/leachable mercury relationship show in FIG. 1 can be used to develop TCLP compliant fluorescent lamps. As the iron content was increased up to 100 milligrams per lamp (mg/lamp), the amount of leachable mercury increased. As the iron content was increased to over 100 mg/lamp, the amount of leachable mercury in the TCLP test decreased. Thus, the use of an iron SAES® shield was a useful material to provide an iron content in a sufficient amount in order to decrease the amount of leachable mercury in the TCLP test as well as provide a low mercury dose technology. The SAES shield is present in a quantity and type of iron that a beneficial impact upon TCLP test performance was observed.

EXAMPLE 5

F18/840 Ecolux® Lamps (obtained from GE Lighting) were tested using the TCLP method. Ascorbic acid was added at 0.3 grams per base without the use of a SAES shield dosed with elemental mercury. Elemental mercury was already present in the lamps. The results in Table 4 show the variability of the leachable mercury when elemental mercury was present in a range between about 6 milligrams and about 11 milligrams. The container size was increased from 1 gallon to 2 gallon containers during the TCLP test. The 2 gallon containers increased the amount of headspace between the TCLP solution and top of the container, thus increasing the amount of oxygen in the container.

TABLE 4

| Sample # | Container Size | Leachable Mercury (ppb) | Total elemental mercury (mg) |
|---|---|---|---|
| 10.6 | 1 gallon | 73 | 6.5 |
| 10.7 | 1 gallon | 71 | 8.2 |
| 10.8 | 1 gallon | 90 | 5.8 |
| 6.1 | 2 gallon | 237 | 8.8 |
| 6.2 | 2 gallon | 143 | 5.8 |
| 6.3 | 2 gallon | 321 | 10.9 |
| 6.4 | 2 gallon | 222 | 8.0 |
| 10.1 | 2 gallon | 137 | 6.3 |
| 10.2 | 2 gallon | 169 | 6.1 |
| 10.4 | 2 gallon | 157 | 6.2 |

Statistically, the 2 gallon TCLP test results had an average leachable mercury value of 198 parts per billion with a standard deviation of 61.

EXAMPLE 6

The combination of the SAES shield with ascorbic acid in the form of an anti-oxidant binder allowed for superior TCLP test performance than without the SAES shield and ascorbic acid. The level of leachable mercury for Polylux XL lamps without the SAES shield and ascorbic acid was typically in a range between about 590 ppb and about 760 ppb for comparable elemental mercury doses to Examples 4 and 5. The results in Table 5 show the TCLP performance of the Polylux XL lamp designs with an elemental mercury dosed iron shield and ascorbic acid. The dose level for elemental mercury was in a range between about 4 milligrams and about 5 milligrams for each experiment, and the ascorbic acid content was approximately 0.6 grams per lamp or 0.34 grams per base. Thus, the use of a SAES shield dosed with elemental mercury and ascorbic acid gave more consistent leachable mercury results than TCLP test results with ascorbic acid only. The container size was increased from 1 gallon to 2 gallon containers during the TCLP test.

Statistically, the 2 gallon TCLP test results had an average leachable mercury value of 134 parts per billion with a standard deviation of 13. Statistics show that there was a lower standard deviation when both ascorbic acid and an elemental mercury dosed iron shield were used compared to when only ascorbic acid was used.

While embodiments have been shown and described, various modifications and substitutions may be made thereto without departing from the spirit and the scope of the invention. Accordingly, it is to be understood that the present invention has been described by way of illustration and not limitation.

What is claimed is:

1. A mercury vapor discharge lamp comprising an effective amount of an antioxidant composition and an iron shield wherein the iron shield comprises a dose of elemental mercury, wherein said dose of elemental mercury is in a range between about 4.0 milligrams and about 5.0 milligrams per lamp.

2. The mercury vapor discharge lamp of claim 1, wherein said antioxidant composition comprises elemental iron, ascorbic acid, sodium ascorbate, or combinations thereof.

3. The mercury vapor discharge lamp of claim 1, wherein said antioxidant composition comprises ascorbic acid.

4. The mercury vapor discharge lamp of claim 1, wherein said antioxidant composition is present in a range between about 1 milligram and about 10 grams per lamp.

5. The mercury vapor discharge lamp of claim 4, wherein said antioxidant composition is present in a range between about 1 milligram and about 1 gram per lamp.

6. The mercury vapor discharge lamp of claim 1, wherein said dose of elemental mercury is about 4.5 milligrams per lamp.

7. The mercury vapor discharge lamp of claim 1, wherein said iron shield and antioxidant substantially prevents the formation of ferric and cupric compounds which oxidize elemental mercury to a soluble form.

8. A mercury vapor discharge lamp comprising an amount of ascorbic acid in a range between about 1 milligram and about 1 gram per lamp and an iron shield wherein the iron shield comprises a dose of mercury at about 4.5 milligrams per lamp wherein the ascorbic acid and iron shield substantially prevent the formation of ferric and cupric compounds which oxidize elemental mercury to a soluble form.

9. A method for preventing the formation of leachable mercury compounds in mercury vapor discharge lamps comprising providing in the lamp structure an effective amount of an antioxidant composition and an iron shield wherein the iron shield comprises a dose of elemental mercury, wherein said dose of elemental mercury is in a range between about 4.0 milligrams and about 5.0 milligrams per lamp.

10. The method of claim 9, wherein said antioxidant composition comprises elemental iron, ascorbic acid, sodium ascorbate, or combinations thereof.

11. The method of claim 9, wherein said antioxidant composition comprises ascorbic acid.

12. The method of claim 9, wherein said antioxidant composition is present in a range between about 1 milligram and about 10 grams per lamp.

13. The method of claim 12, wherein said antioxidant composition is present in a range between about 1 milligram and about 1 gram per lamp.

14. The method of claim 9, wherein said dose of elemental mercury is about 4.5 milligrams per lamp.

15. The method of claim 9, wherein said iron shield and antioxidant substantially prevent the formation of ferric and cupric compounds which oxidize elemental mercury to a soluble form.

16. A method for preventing the formation of leachable mercury compounds in mercury vapor discharge lamps comprising providing an amount of ascorbic acid in a range between about 1 milligram and about 1 gram per lamp and an iron shield wherein the iron shield comprises a dose of elemental mercury at about 4.5 milligrams per lamp wherein the ascorbic acid and iron shield substantially prevent the formation of ferric and cupric compounds which oxidize elemental mercury to a soluble form.

* * * * *